US011052004B2

(12) United States Patent
Ross

(10) Patent No.: US 11,052,004 B2
(45) Date of Patent: Jul. 6, 2021

(54) INTERCHANGEABLE SIDE RAILS FOR A PATIENT SUPPORT APPARATUS

(71) Applicant: Stryker Corporation, Kalamazoo, MI (US)

(72) Inventor: Ryan Ross, New Carlisle, IN (US)

(73) Assignee: Stryker Corporation, Kalamazoo, MI (US)

( * ) Notice: Subject to any disclaimer, the term of this patent is extended or adjusted under 35 U.S.C. 154(b) by 144 days.

(21) Appl. No.: 16/361,401

(22) Filed: Mar. 22, 2019

(65) Prior Publication Data

US 2019/0290517 A1 Sep. 26, 2019

Related U.S. Application Data

(60) Provisional application No. 62/647,004, filed on Mar. 23, 2018.

(51) Int. Cl.
*A61G 7/05* (2006.01)
*A61G 7/057* (2006.01)

(52) U.S. Cl.
CPC ..... *A61G 7/0524* (2016.11); *A61G 7/0508* (2016.11); *A61G 7/0518* (2016.11); *A61G 7/05769* (2013.01); *A61G 2203/10* (2013.01)

(58) Field of Classification Search
CPC .. A61G 7/0508; A61G 7/0509; A61G 7/0518; A61G 7/0524; A61G 7/05769; A61G 2203/10
See application file for complete search history.

(56) References Cited

U.S. PATENT DOCUMENTS 4,027,343 A 6/1977 Hooker
4,183,015 A * 1/1980 Drew ..... A61G 7/0507 340/286.07
5,542,136 A * 8/1996 Tappel ..... A61G 7/05776 5/658

(Continued)

FOREIGN PATENT DOCUMENTS

AU 2010202928 A1 1/2011
CN 2173001 Y 8/1994

(Continued)

OTHER PUBLICATIONS

English language abstract and machine-assisted English translation for CN2173001 extracted from espacenet.com database on Apr. 17, 2019, 4 pages.

(Continued)

*Primary Examiner* — David R Hare
*Assistant Examiner* — Alexis Felix Lopez
(74) *Attorney, Agent, or Firm* — Howard & Howard Attorneys PLLC

(57) ABSTRACT

A patient support apparatus comprises a support structure and a first side rail. The support structure comprises a base and a patient support surface for supporting a patient. A side rail connector is coupled to the support structure. The first side rail is removably coupled to the support structure by the side rail connector. The first side rail is configured to be removable from the support structure and interchanged with a second side rail. The second side rail is configured to be removably coupled to the support structure by the side rail connector.

14 Claims, 13 Drawing Sheets

(56) References Cited

U.S. PATENT DOCUMENTS

| | | | | |
|---|---|---|---|---|
| 5,802,636 | A | 9/1998 | Corbin et al. | |
| 6,240,580 | B1 | 6/2001 | Hamilton et al. | |
| 6,701,554 | B2 | 3/2004 | Heimbrock | |
| 6,884,255 | B1 | 4/2005 | Newton | |
| 7,570,152 | B2 | 8/2009 | Smith et al. | |
| 7,591,796 | B1 | 9/2009 | Barak et al. | |
| 8,572,778 | B2 | 11/2013 | Newkirk et al. | |
| 8,677,528 | B2 | 3/2014 | Hookway et al. | |
| 8,756,078 | B2 | 6/2014 | Collins, Jr. et al. | |
| 8,776,286 | B1 * | 7/2014 | Edgerton | A61G 7/0509 5/430 |
| 8,864,205 | B2 | 10/2014 | Lemire et al. | |
| 9,259,371 | B2 | 2/2016 | Zerhusen | |
| 9,306,322 | B2 | 4/2016 | Bhimavarapu et al. | |
| 9,375,374 | B2 * | 6/2016 | Herman | A61G 7/0524 |
| 9,569,591 | B2 | 2/2017 | Vanderpohl, III | |
| 9,642,759 | B2 | 5/2017 | Stryker et al. | |
| 10,080,438 | B2 | 9/2018 | Paul et al. | |
| 10,172,753 | B2 | 1/2019 | Tessmer et al. | |
| 10,507,158 | B2 * | 12/2019 | Brzenchek | A61H 1/008 |
| 2003/0033790 | A1 | 2/2003 | Hague | |
| 2006/0053554 | A1 | 3/2006 | Acton | |
| 2006/0117481 | A1 * | 6/2006 | Stryker | A61G 7/0524 5/430 |
| 2010/0199428 | A1 * | 8/2010 | Guguin | A61G 7/0509 5/430 |
| 2011/0030141 | A1 * | 2/2011 | Soderberg | A61B 5/4839 5/600 |
| 2011/0113562 | A1 * | 5/2011 | Uzzle | A61G 7/05769 5/713 |
| 2011/0162142 | A1 | 7/2011 | Hakamiun et al. | |
| 2011/0247137 | A1 | 10/2011 | Herman et al. | |
| 2014/0080413 | A1 * | 3/2014 | Hayes | A61G 7/05 455/41.1 |
| 2014/0297327 | A1 | 10/2014 | Heil et al. | |
| 2015/0115638 | A1 | 4/2015 | Lambarth et al. | |
| 2015/0135436 | A1 | 5/2015 | Stryker et al. | |
| 2016/0013837 | A1 | 1/2016 | Howell et al. | |
| 2016/0302985 | A1 | 10/2016 | Tessmer et al. | |
| 2017/0020757 | A1 | 1/2017 | Tessmer et al. | |
| 2017/0027789 | A1 * | 2/2017 | St.John | A61G 7/0506 |
| 2017/0079434 | A1 | 3/2017 | Paul et al. | |
| 2017/0143566 | A1 * | 5/2017 | Elku | A61G 7/0507 |
| 2017/0172829 | A1 | 6/2017 | Tessmer et al. | |
| 2017/0172838 | A1 | 6/2017 | Brosnan et al. | |
| 2017/0246065 | A1 | 8/2017 | Connell et al. | |
| 2017/0319412 | A1 | 11/2017 | Herman et al. | |

FOREIGN PATENT DOCUMENTS

| | | | |
|---|---|---|---|
| DE | 202008001907 | U1 | 4/2008 |
| JP | H08164037 | A | 6/1996 |
| JP | 2001276150 | A | 10/2001 |
| JP | 2002078758 | A | 3/2002 |
| JP | 3395004 | B2 | 4/2003 |
| JP | 2003522602 | A | 7/2003 |
| JP | 2006051212 | A | 2/2006 |
| KR | 101111697 | B1 | 2/2012 |
| KR | 101649843 | B1 | 8/2016 |

OTHER PUBLICATIONS

Machine-assisted English translation for DE 20 2008 001 907 extracted from espacenet.com database on Apr. 17, 2019, 12 pages.

English language abstract and machine-assisted English translation for JPH 08-164037 extracted from espacenet.com database on Apr. 17, 2019, 11 pages.

English language abstract and machine-assisted English translation for JP 2001-276150 extracted from espacenet.com database on Apr. 17, 2019, 15 pages.

English language abstract and machine-assisted English translation for JP 2002-078758 extracted from espacenet.com database on Apr. 17, 2019, 13 pages.

English language abstract and machine-assisted English translation for JP 3395004 extracted from espacenet.com database on Apr. 17, 2019, 8 pages.

English language abstract for JP 2003-522602 extracted from espacenet.com database on Apr. 17, 2019, 1 page.

English language abstract and machine-assisted English translation for JP 2006-051212 extracted from espacenet.com database on Apr. 17, 2019, 14 pages.

English language abstract and machine-assisted English translation for KR 10111697 extracted from espacenet.com database on Apr. 17, 2019, 12 pages.

English language abstract and machine-assisted English translation for KR 101649843 extracted from espacenet.com database on Apr. 17, 2019, 18 pages.

* cited by examiner

INTERCHANGEABLE SIDE RAILS FOR A PATIENT SUPPORT APPARATUS

CROSS-REFERENCE TO RELATED APPLICATION

This application claims priority to and the benefit of U.S. Provisional Patent Application Ser. No. 62/647,004, filed on Mar. 23, 2018, the entire contents of which are hereby incorporated by reference.

BACKGROUND

Patient support apparatuses, such as hospital beds, stretchers, cots, tables, wheelchairs, and chairs facilitate care of patients in a health care setting. Conventional patient support apparatuses comprise a support structure having a base, a frame, a patient support deck on the frame upon which the patient is supported, a lift system for lifting and lowering the patient support deck relative to the base, and an articulation system for articulating one or more sections of the patient support deck. The patient support apparatus may further comprise a headboard, a footboard, and/or one or more side rails mounted to the frame.

Current patient support apparatuses need to support multiple accessories to provide therapy to the patient, such as, for example, oxygen or IV lines, deep vein thrombosis pumps, mattress pumps for rotation therapy, etc. However, such accessories are typically external to the patient support apparatus. These external accessories, which include various cables, hoses, and power cords, must be attached to existing parts of the patient support apparatus for support. For example, such accessories are typically hung from or draped over a headboard, footboard, or side rail. This weighs down the patient support apparatus, making it harder for caregivers to move the patient support apparatus from one location to another. It also increases the footprint of the patient support apparatus, which is not desirable when the patient support apparatus must be moved into a small space such as an elevator. Finally, external accessories are often cumbersome and may impede or even block a caregiver's access to the patient, such as in an emergency situation when the caregiver may need immediate and unobstructed access to parts of the patient's body.

A patient support apparatus is desired that addresses one or more of the aforementioned challenges.

DETAILED DESCRIPTION

Figure 1:
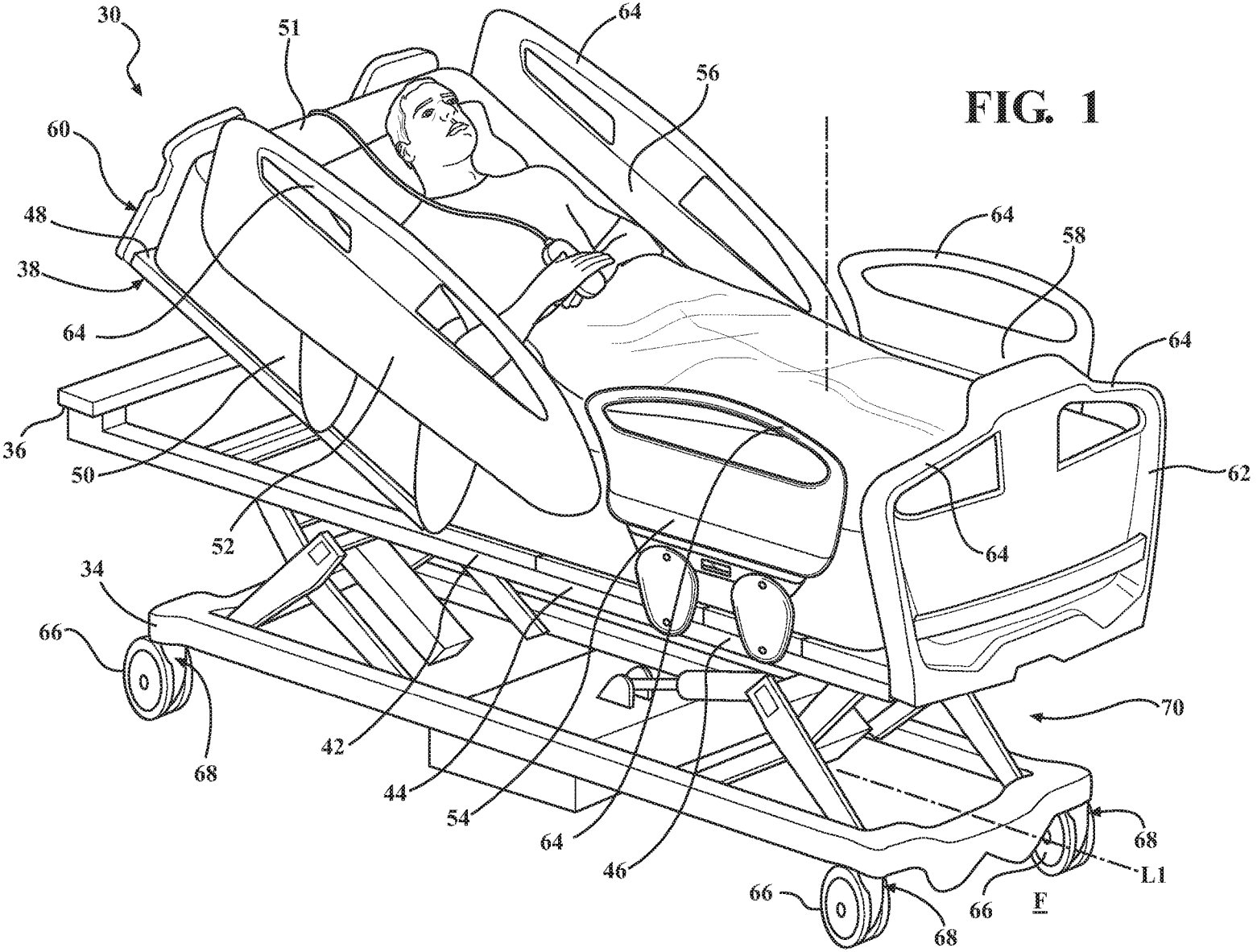
FIG. 1 is a perspective view of a patient support apparatus.

Referring to FIG. 1, a patient support apparatus 30 is shown for supporting a patient in a health care setting. The patient support apparatus 30 illustrated in FIG. 1 comprises a hospital bed. In other embodiments, however, the patient support apparatus 30 may comprise a stretcher, cot, table, wheelchair, chair, or similar apparatus utilized in the care of a patient.

A support structure 32 provides support for the patient. The support structure 32 illustrated in FIG. 1 comprises a base 34 and a support frame 36 disposed above the base 34 and supported by the base 34. The support structure 32 also comprises a patient support deck 38 disposed on the support frame 36. The patient support deck 38 comprises first, second, third, and fourth sections, some of which are capable of articulating (e.g., pivoting) relative to the support frame 36, such as a fowler (back) section 40, a seat section 42, a leg section 44, and a foot section 46. The patient support deck 38 provides a patient support surface 48 upon which the patient is supported.

A mattress 50 is disposed on the patient support deck 38 during use. The mattress 50 comprises a secondary patient support surface 51 upon which the patient is supported. The base 34, support frame 36, patient support deck 38, and patient support surfaces 48, 51 each have an upper section comprising a head end and a lower section comprising a foot end corresponding to designated placement of the patient's head and feet on the patient support apparatus 30. The base 34 comprises a longitudinal axis L1 along its length from the head end to the foot end. The base 34 also comprises a vertical axis V arranged crosswise (e.g., perpendicularly) to the longitudinal axis L1 along which the support frame 36 is lifted and lowered relative to the base 34. The construction of the support structure 32 may take on any known or conventional design, and is not limited to that specifically set forth above. In addition, the mattress may be omitted in certain embodiments, such that the patient rests directly on the patient support surface 48.

Patient barriers, such as side rails 52, 54, 56, 58 are coupled to the support frame 36 and/or the patient support deck 38 and are thereby supported by the base 34. If the patient support apparatus 30 is a stretcher or a cot, there may be fewer side rails. In some embodiments, wiring/cables may be routed from the patient support apparatus 30 to the side rails 52, 54, 56, 58. One exemplary side rail assembly comprising a cable pathway routed through pivoting components is described in U.S. Pat. No. 10,080,438 to Paul et al., filed on Sep. 16, 2016, entitled "Patient Support Apparatus," hereby incorporated by reference herein in its entirety.

A headboard assembly 60 and a footboard 62 are coupled to the support structure 32. The footboard 62 may be coupled to any location on the patient support apparatus 30, such as the support frame 36 or the base 34. The headboard assembly 60 is coupled to the fowler section 40 in certain embodiments described further below, but in other embodiments may be coupled to the support frame 36, the base 34, or other suitable locations.

Caregiver interfaces 64, such as handles, are shown integrated into the footboard 62, and the side rails 52, 54, 56, 58 to facilitate movement of the patient support apparatus 30 over a floor surface F. Additional caregiver interfaces 64 may be integrated into other components of the patient support apparatus 30. The caregiver interfaces 64 are graspable by the caregiver to manipulate the patient support apparatus 30 for movement, to move the side rails 52, 54, 56, 58, and the like.

Other forms of the caregiver interface 64 are also contemplated. The caregiver interface 64 may comprise one or more handles coupled to the support frame 36. The caregiver interface 64 may simply be a surface on the patient support apparatus 30 upon which the caregiver logically applies force to cause movement of the patient support apparatus 30 in one or more directions, also referred to as a push location. This may comprise one or more surfaces on the support frame 36 or base 34. This could also comprise one or more surfaces on or adjacent to the headboard assembly 60, the footboard 62, and/or the side rails 52, 54, 56, 58. In other embodiments, the caregiver interface 64 may comprise separate handles for each hand of the caregiver. For example, the caregiver interface may comprise two handles.

Wheels 66 are coupled to the base 34 to facilitate transport over the floor surface F. The wheels 66 are arranged in each of four quadrants of the base 34 adjacent to corners of the base 34. In the embodiment shown, the wheels 66 are caster wheels able to rotate and swivel relative to the support structure 32 during transport. Each of the wheels 66 forms part of a caster assembly 68. Each caster assembly 68 is mounted to the base 34. It should be understood that various configurations of the caster assemblies 68 are contemplated. In addition, in some embodiments, the wheels 66 are not caster wheels and may be non-steerable, steerable, non-powered, powered, or combinations thereof. Additional wheels are also contemplated. For example, the patient support apparatus 30 may comprise four non-powered, non-steerable wheels, along with one or more powered wheels. In some cases, the patient support apparatus 30 may not include any wheels.

In other embodiments, one or more auxiliary wheels (powered or non-powered), which are movable between stowed positions and deployed positions, may be coupled to the support structure 32. In some cases, when these auxiliary wheels are located between caster assemblies 68 and contact the floor surface F in the deployed position, they cause two of the caster assemblies 68 to be lifted off the floor surface F, thereby shortening a wheel base of the patient support apparatus 30. A fifth wheel may also be arranged substantially in a center of the base 34.

The patient support apparatus 30 may further comprise a lift system 70 that operates to lift and lower the support frame 36/patient support deck 38 relative to the base 34. The lift system 70 is configured to move the support frame 36/patient support deck 38 to any desired position. One exemplary lift system 70 is described below and in U.S. Patent Application Pub. No. 2017/0246065 to Connell et al., filed on Feb. 22, 2017, entitled "Lift Assembly for Patient Support Apparatus," hereby incorporated by reference herein in its entirety. Other types of lift systems can also be used, such as those described in U.S. Pat. No. 10,172,753 to Tessmer et al., filed on Apr. 20, 2016, entitled "Patient Support Lift Assembly," hereby incorporated by reference herein in its entirety.

A control system is provided to control operation of the patient support apparatus 30. The control system comprises a controller 67 having one or more microprocessors for processing instructions or for processing an algorithm stored in memory to control operation of the patient support apparatus 30. The controller 67 may be in communication with and may control any suitable components of the patient support apparatus 30, such as the electrical or electromechanical components described herein. The controller 67 may comprise any suitable signal processing means, computer executable instructions or software modules stored in memory, including non-volatile memory or volatile memory, wherein the executable instructions or modules may be executed by a processor, or the like. Additionally, or alternatively, the controller 67 may comprise a microcontroller, a processor, one or more integrated circuits, logic parts, and the like for enabling the same. The controller 67 may have any suitable configuration for enabling performance of various tasks related to operation of the patient support apparatus 30. The controller 67 may be located at any suitable location of the patient support apparatus 30.

Standard Side Rails

Standard side rails 52, 54, 56, 58 are illustrated in FIG. 1. The standard side rails 52, 54, 56, 58 differ from traditional side rails in that they are configured to be fully interchangeable with other side rail assemblies disclosed herein. However, in some embodiments, the standard side rail 52, 54, 56, 58 otherwise may function solely as a traditional side rail and may lack any additional accessory having a feature/function controlled by electronic controls or user interfaces. A first side rail 52 is positioned at a right head end. A second side rail 54 is positioned at a right foot end. A third side rail 56 is positioned at a left head end. A fourth side rail 58 is positioned at a left foot end. In the embodiment shown, the head end side rails 52, 56 are mounted to the fowler section 40 for movement with the fowler section 40. The foot end side rails 54, 58 are mounted to the support frame 36 for movement with the support frame 36. The side rails 52, 54, 56, 58 may be movable relative to the fowler section 40/support frame 36 to a raised position in which they block ingress and egress into and out of the patient support apparatus 30, one or more intermediate positions, and a lowered position in which they are not an obstacle to such ingress and egress. In an alternate embodiment, the side rails 52, 54, 56, 58 may be non-adjustable.

Figure 2A:
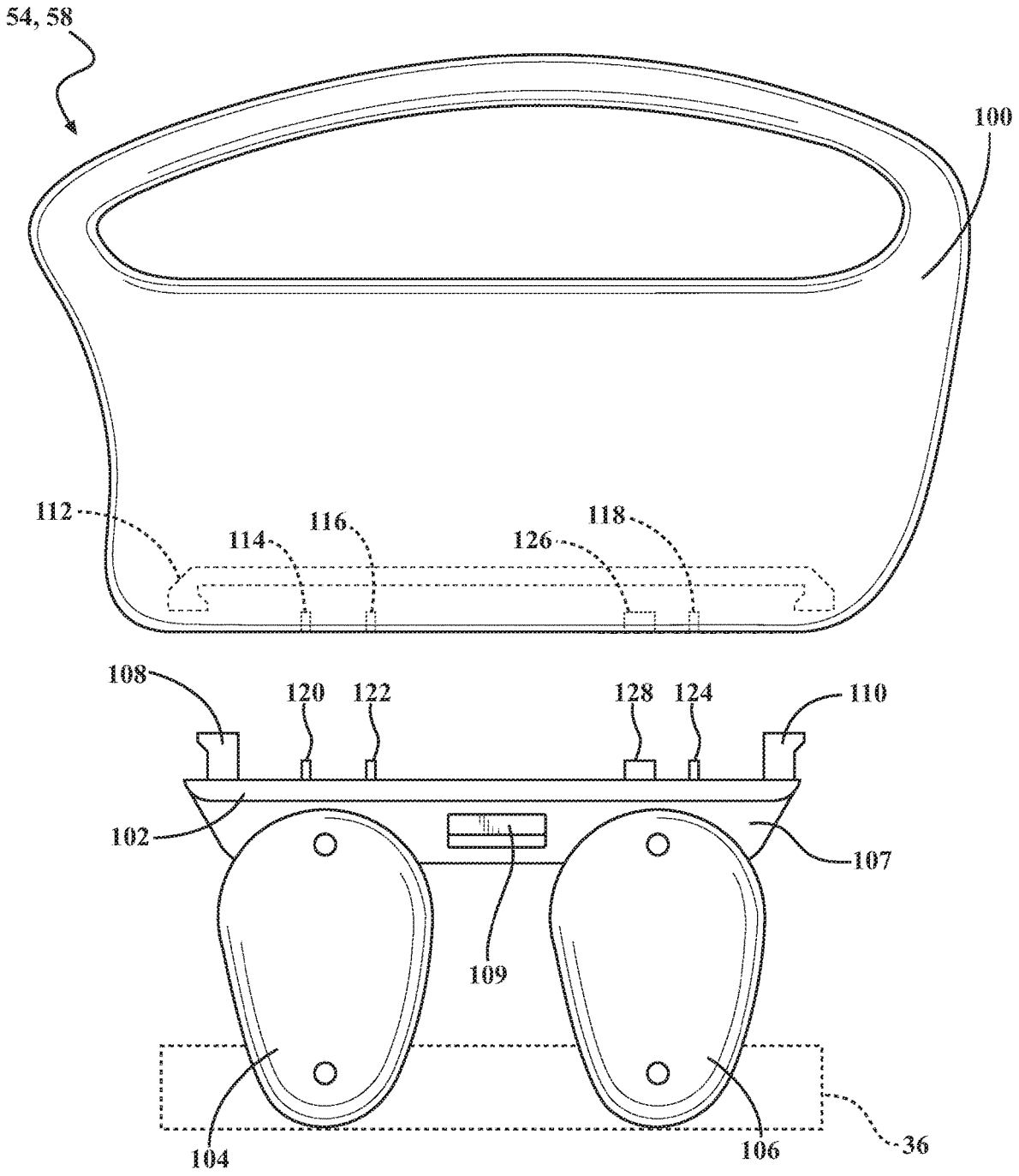
FIG. 2A is an exploded front view of a standard side rail assembly of the patient support apparatus.

Referring now to FIG. 2A, an exploded front view of a standard side rail assembly of the patient support apparatus 30 is shown. A standard side rail (shown as 54, 58 but, in alternate embodiments, may include 52, 56 or combinations thereof) includes a side rail body 100 and a side rail connector 102.

The side rail connector 102 may comprise support arms 104, 106, which may be coupled to the support frame 36 (as shown in FIG. 1). The support arms 104, 106 may be pivotally connected to a connector body 107 of the side rail connector 102. The support arms 104, 106 may operate in a conventional manner when raising and lowering the standard side rail assembly relative to the support frame 36. For instance, the support arms 104, 106 and the connector body 107 may form a 4-bar linkage with the support frame 36. A release handle 109 and associated position adjustment mechanism may be incorporated into the connector body 107 to hold and/or release the standard side rail assembly for movement to any desired position. Such 4-bar arrangements are shown in U.S. Patent Application Pub. No. 2017/0020757 to Tessmer et al., filed on Jul. 22, 2016, entitled, "Patient Support Apparatus With Side Rail," hereby incorporated herein by reference. Powered movement of the support arms 104, 106 and the connector body 107 relative to the support frame 36 is also possible using the mechanisms disclosed in U.S. Patent Application Pub. No. 2017/0172829 to Tessmer et al., filed on Dec. 15, 2016, entitled, "Powered Side Rail For A Patient Support Apparatus," hereby incorporated herein by reference.

The side rail connector 102 may further include latches 108, 110. When the side rail connector 102 is coupled to the side rail body 100, the latches 108, 110 engage with a retaining bar 112, which is contained within the side rail body 100. The latches 108, 110 may releasably snap-fit into the retaining bar 112. The latches 108, 110 and the retaining bar 112 define one set of couplings that could be used for coupling the side rail body 100 to the side rail connector 102. It will be understood and appreciated that any other type of coupling and/or locking mechanism may be used to couple the side rail body 100 to the side rail connector 102. In other embodiments, the side rail body 100 may be attached to the side rail connector 102 by fasteners, press-fit, other snap-lock features, combinations thereof, and the like.

Figure 2B:
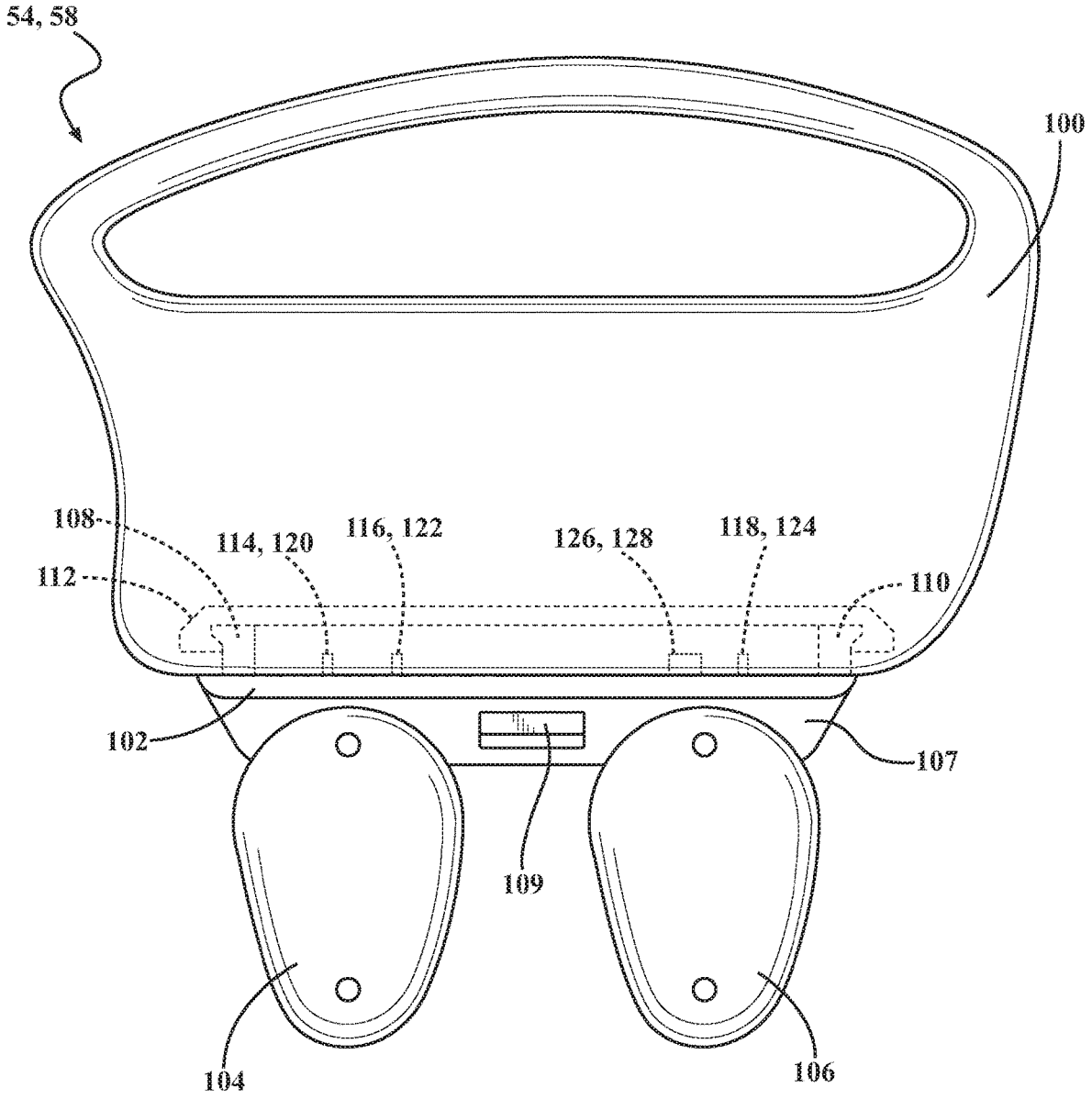
FIG. 2B is a front view of the standard side rail assembly of FIG. 2A.
Figure 2C:
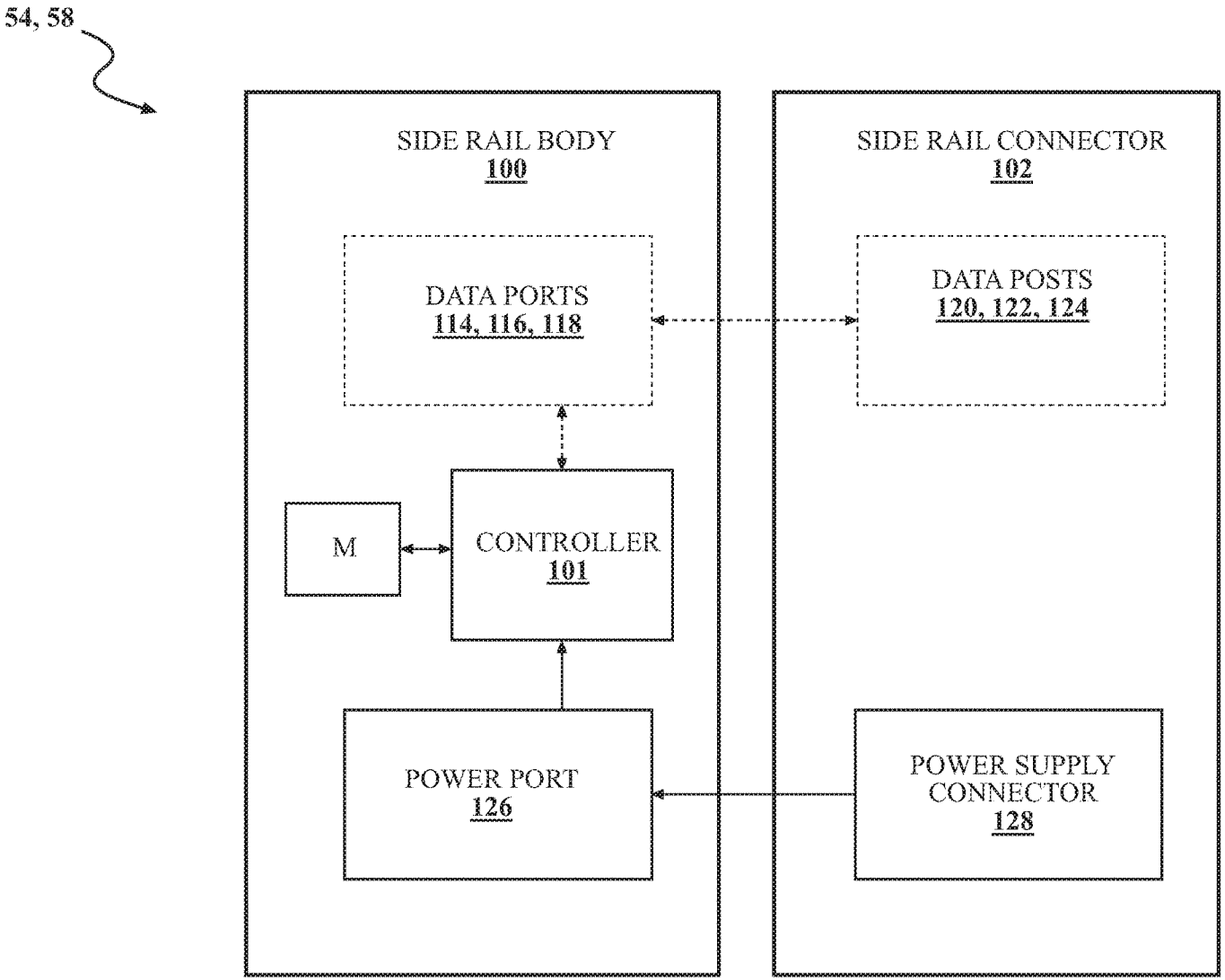
FIG. 2C is a diagram illustrating the standard side rail assembly of FIGS. 2A-2B.

In some embodiments, the side rail body 100 comprises one or more data connectors, such as the data ports 114, 116, 118 connected to a controller 101 (see FIG. 2C). The side rail connector 102 may also include one or more data connectors, such as data posts 120, 122, and 124 that connect into data ports 114, 116, and 118 when the side rail body 100 is coupled to the side rail connector 102. The data connectors enable the transmission of data between the side rail body 100 and the patient support apparatus 30. Such data may comprise the type of side rail assembly that has been connected and which accessories are available for use (e.g., DVT assembly, air mattress pump assembly, etc.) (see FIG. 2C). Other types of data may also be exchanged. Such data may be stored in one or more memory devices M (see FIG. 2C) on-board the side rail body 100, such as non-volatile memory, NVRAM, EEPROM, or other forms of memory devices that can be accessed via the data connections. The data connectors may be wireless and/or wired, including USB connectors, Firewire connectors, Ethernet connectors, lightning connectors, combinations thereof, and the like. It will be understood and appreciated that more or fewer data connections may be present than shown in the illustrated embodiment. Furthermore, fewer than all available data connections may be utilized at any given time.

In addition, the side rail body 100 may include a power connector, which may be wireless or wired, such as power port 126 for receiving another power connector, such as power supply connector 128, which supplies power to the side rail body 100 as needed to support the functions of the side rail 54, 58. In certain embodiments, the side rail body 100 may include a power connector but no data connector. In such embodiments, the side rail body 100 may require power but utilize only the controller 101 to control the functions of the side rail 52, 54, 56, 58 itself, such that data communication between the side rail body 100 and the patient support apparatus 30 is not required.

It should be appreciated that in certain embodiments, the data connectors and power connectors may enable wireless data communication and/or power coupling, such as through radio frequency communication (e.g., Bluetooth, Zigbee, etc.), inductive coupling, and the like. The data connections may enable communication between the controller 101 on-board the side rail body 100 and the controller 67 of the patient support apparatus 30, and/or network communication between the controller 101 and a bed network, local area network (LAN), a wide area network (WAN), and the like.

The controller 101 may be in communication with and may control any suitable components of the side rail 54, 58. The controller 101 may comprise any suitable signal processing means, computer executable instructions or software modules stored in a memory, including any type of memory, including volatile and non-volatile memory, wherein the executable instructions or modules may be executed by a processor, or the like. Additionally, or alternatively, the controller 101 may comprise a microcontroller, a processor, one or more integrated circuits, logic parts, and the like for enabling the same. The controller 101 may have any suitable configuration for enabling performance of various tasks related to operation of the side rail 54, 58. The controller 101 may be located at any suitable location of the side rail 54, 58.

Referring now to FIG. 2B, a front view of the standard side rail assembly is shown. The side rail body 100 is shown coupled to the side rail connector 102. The latches 108, 110 are engaged with the retaining bar 112 to hold the side rail body 100 in place. The data posts 120, 122, and 124 are engaged in the data ports 114, 116, and 118, respectively. The power supply connector 128 is engaged with the power port 126.

Referring now to FIG. 2C, a diagram illustrating the standard side rail assembly is shown. Electrical connections and data connections are illustrated in FIG. 2C.

Notably, in some embodiments, the standard side rail assembly lacks any functionality directly usable by the patient or the caregiver. In other words, aside from having the memory M and the controller 101 to identify itself to the controller 67 and/or a network as being the standard side rail assembly, the standard side rail assembly lacks any electronic controls or user interface. As described further below, side rail bodies of other forms are possible that can similarly be connected to the same side rail connector 102. These alternative side rail bodies may provide one or more functions for use by the patient and/or the caregiver. The interchangeability among the various side rail bodies provides manufacturers, caregivers, and others with the ability to easily customize the patient support apparatus 30 to better accommodate different patients that may have different treatment needs.

Deep Vein Thrombosis (DVT) Side Rails

Figure 3A:
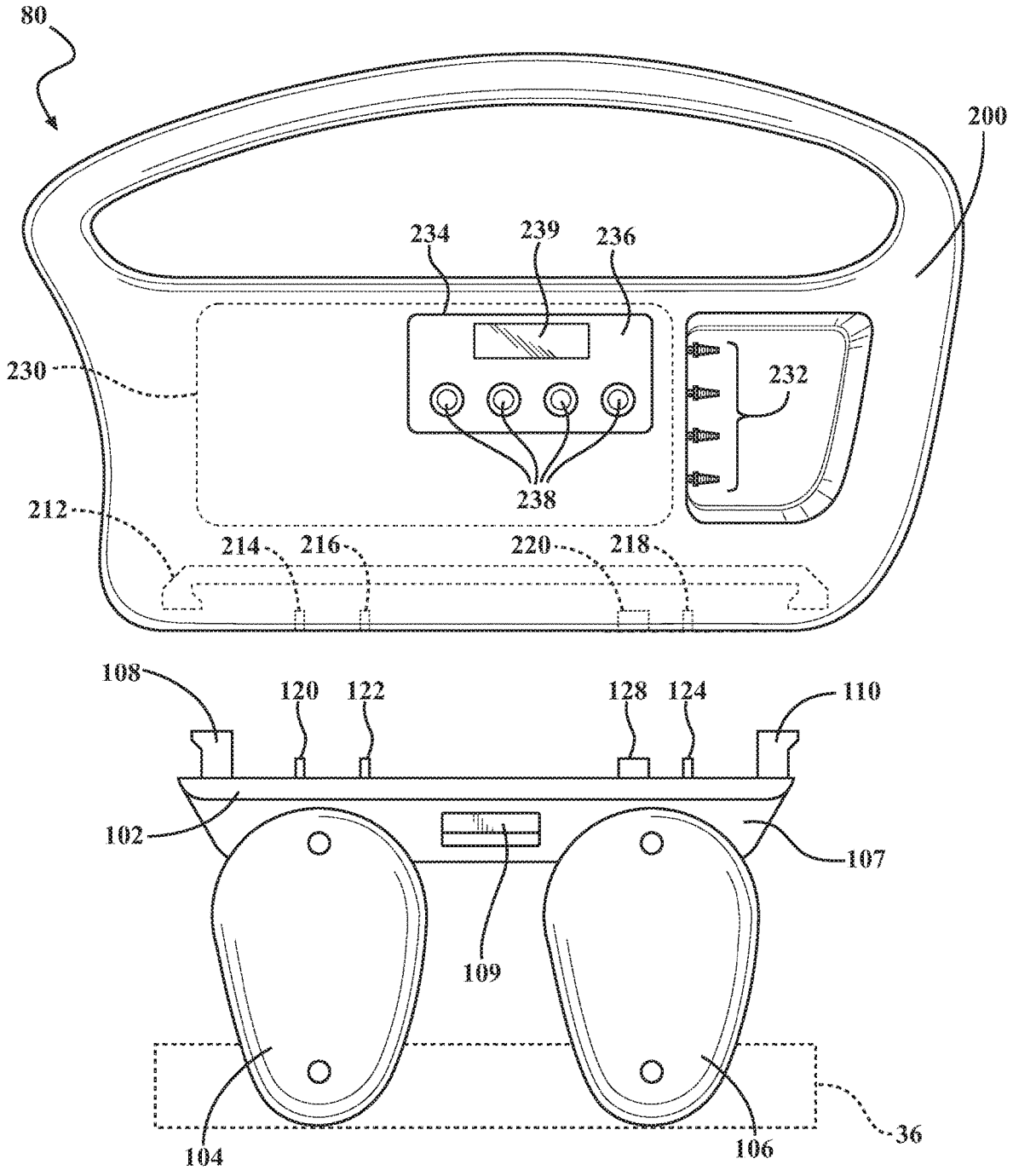
FIG. 3A is an exploded front view of a DVT side rail assembly of the patient support apparatus.

Referring now to FIG. 3A, an exploded front view of a deep vein thrombosis (DVT) side rail assembly of the patient support apparatus 30 is shown. A DVT side rail 80 may include all features and functions of the standard side rail 54, 58, as discussed above with reference to FIGS. 2A-2C. The DVT side rail 80 includes a side rail body 200 and the side rail connector 102. As previously discussed, the side rail connector 102 may comprise the support arms 104, 106, which may be coupled to the support frame 36 (as shown in FIG. 1). The side rail connector 102 may further include the latches 108, 110. When the side rail connector 102 is coupled to the side rail body 200, the latches 108, 110 engage with a retaining bar 212, which is contained within the side rail body 200. It will be understood and appreciated that any other type of coupling and/or locking mechanism may be used to couple the side rail body 200 to the side rail connector 102.

The side rail body 200 may further include data connectors, such as data ports 214, 216, 218 to interface with the data posts 120, 122, and 124 when the side rail body 200 is coupled to the side rail connector 102. In addition, the side rail body 200 may include a power port 220 for receiving the power supply connector 128, which supplies power to the side rail body 200 as needed to support the functions of the DVT side rail 80.

The DVT side rail 80 further includes a DVT pump 230 contained entirely within the DVT side rail body 200. The DVT pump 230 is coupled to DVT ports 232 (although four DVT ports 232 are shown, it will be understood that more or fewer ports may be included). Additionally, the DVT ports 232 may be attached at any suitable location on the DVT side rail 80, such as protruding into a window opening through the side rail body 200 as shown, protruding into a window opening defined by the handle, or the like. The DVT ports 232 (also referred to as fluid ports) may connect to tubing on DVT garments 240 (see FIG. 3C), such as DVT foot sleeves, leg sleeves, and the like, which can be placed on the patient. The DVT pump 230 pumps air in and out of the DVT garments 240 via the DVT ports 232 in a known manner, which improves circulation in the patient's legs in an effort to prevent blood clots from forming. The DVT side rail 80 may further include a DVT pump controller 234 carried on-board and coupled to the DVT pump 230, and a user interface 236 with user inputs 238, a display 239, and the like, for controlling the functions of the DVT pump 230 and the DVT ports 232. The user interface 236 is coupled to the DVT pump controller 234 and may be located on the interior (patient-facing) or exterior (caregiver facing), or both, of the DVT side rail body 200 (see FIGS. 5A-5B). Other forms of user interfaces are also possible, such as touch-screen interfaces, and the like.

The DVT pump controller 234 may be in communication with and may control any suitable components of the DVT side rail 80. The DVT pump controller 234 may comprise any suitable signal processing means, computer executable instructions or software modules stored in a memory M (see FIG. 3C), including non-volatile memory or volatile memory, wherein the executable instructions or modules may be executed by a processor, or the like. Additionally, or alternatively, the DVT pump controller 234 may comprise a microcontroller, a processor, one or more integrated circuits, logic parts, and the like for enabling the same. The DVT pump controller 234 may have any suitable configuration for enabling performance of various tasks related to operation of the DVT side rail 80. The DVT pump controller 234 may be located at any suitable location of the DVT side rail 80.

Figure 3B:
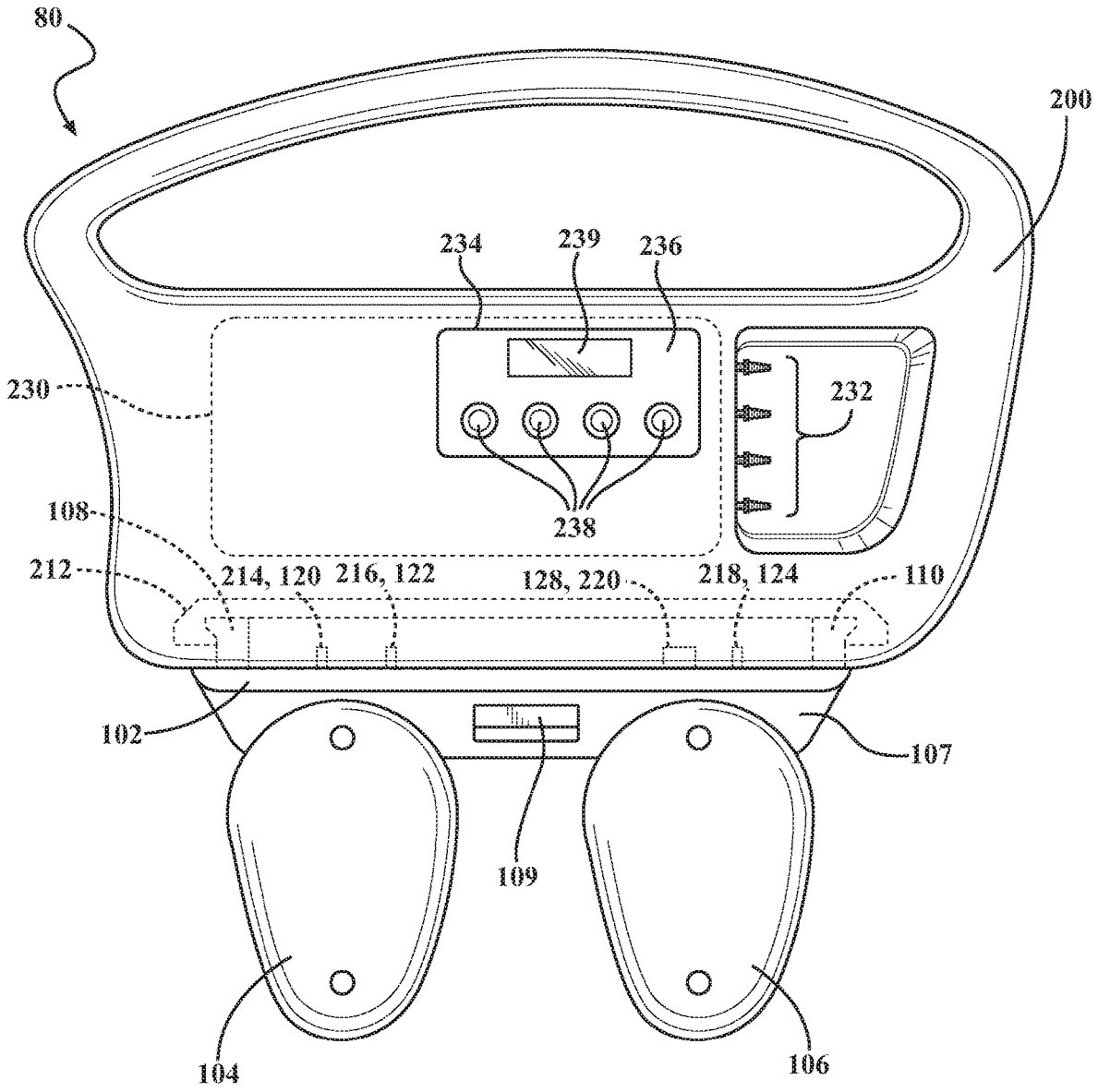
FIG. 3B is a front view of the DVT side rail assembly of FIG. 3A.

Referring now to FIG. 3B, a front view of the DVT side rail assembly in its assembled form is shown. The side rail body 200 is shown coupled to the side rail connector 102. The latches 108, 110 are engaged with the retaining bar 212 to hold the side rail body 200 in place. The data posts 120, 122, and 124 are engaged in the data ports 214, 216, and 218, respectively. The power supply connector 128 is engaged with the power port 220.

Figure 3C:
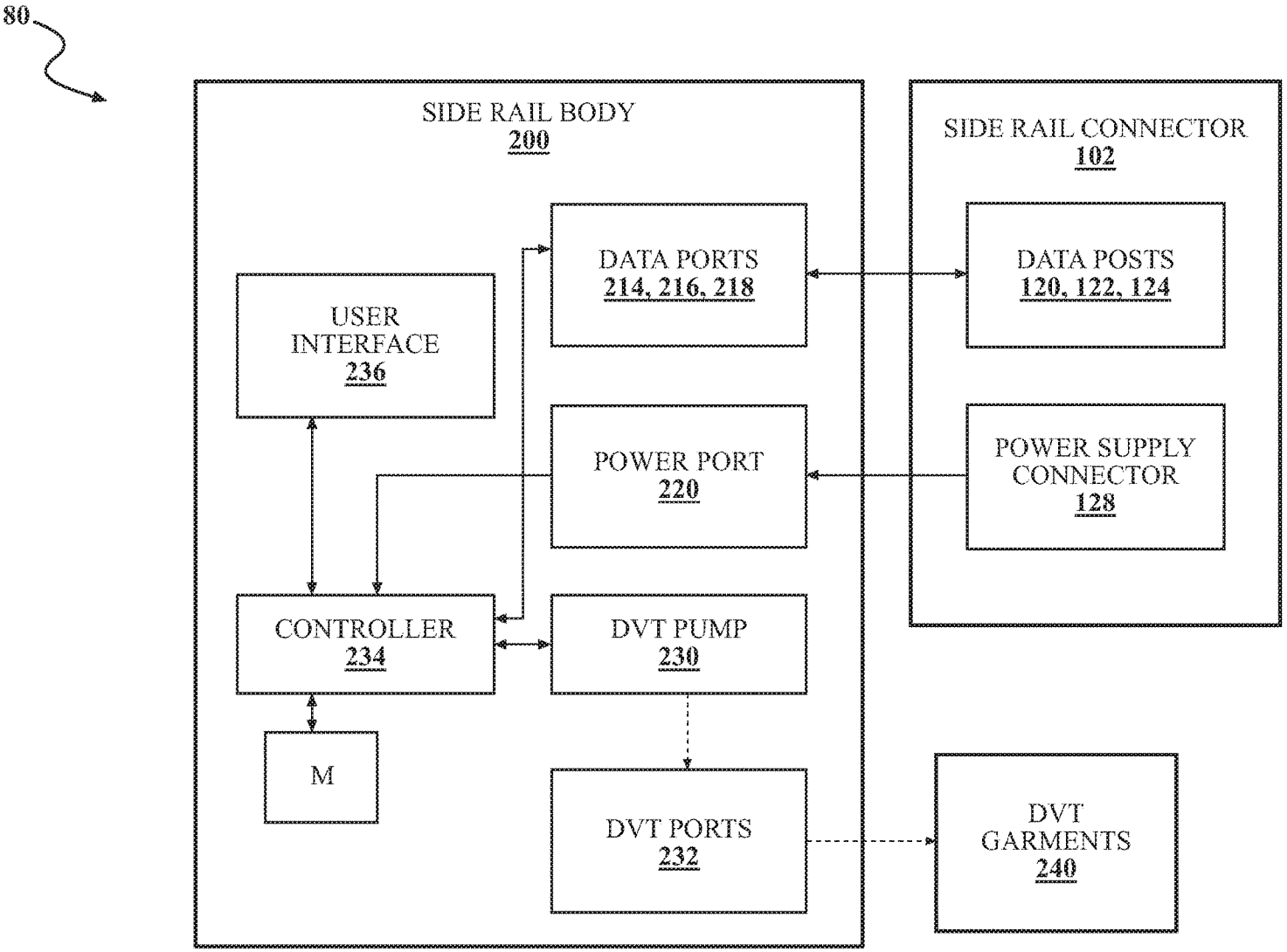
FIG. 3C is a diagram illustrating the DVT side rail assembly of FIGS. 3A-3B.

Referring now to FIG. 3C, a diagram illustrating the DVT side rail assembly is shown. Electrical connections, data connections, and air flow connections are illustrated in FIG. 3C. One exemplary DVT system that can be integrated into the DVT side rail 80 to inflate and deflate the DVT garments 240 in a desired manner is shown in U.S. Pat. No. 9,642,759 to Stryker et al., filed on Nov. 20, 2014, entitled "Patient Support With Universal Energy Supply System," hereby incorporated herein by reference.

Air Mattress Side Rails

Figure 4A:
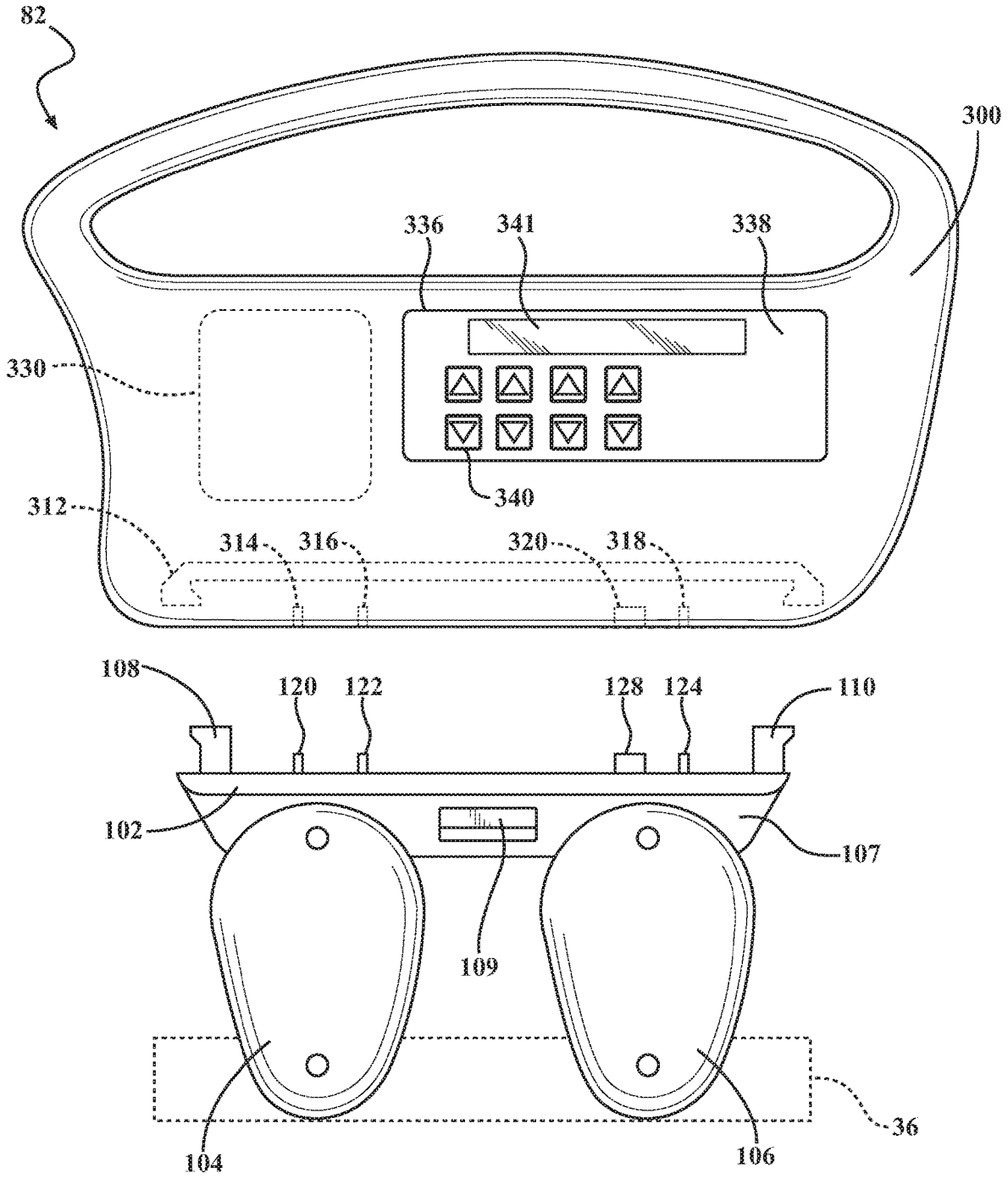
FIG. 4A is an exploded front view of an air mattress side rail assembly of the patient support apparatus.

Referring now to FIG. 4A, an exploded front view of an air mattress side rail assembly of the patient support apparatus 30 is shown. An air mattress side rail 82 may include all features and functions of the standard side rail 54, 58, as discussed above with reference to FIGS. 2A-2C. The air mattress side rail 82 includes a side rail body 300 and the side rail connector 102. As previously discussed, the side rail connector 102 may comprise the support arms 104, 106, which may be coupled to the support frame 36 (as shown in FIG. 1). The side rail connector 102 may further include the latches 108, 110. When the side rail connector 102 is coupled to the side rail body 300, the latches 108, 110 engage with a retaining bar 312, which is contained within the side rail body 300. It will be understood and appreciated that any other type of coupling and/or locking mechanism may be used to couple the side rail body 300 to the side rail connector 102.

The side rail body 300 may further include data connectors, such as data ports 314, 316, 318 to interface with the data posts 120, 122, and 124 when the side rail body 300 is coupled to the side rail connector 102. In addition, the side rail body 300 may include a power port 320 for receiving the power supply connector 128, which supplies power to the side rail body 300 as needed to support the functions of the air mattress side rail 82.

The air mattress side rail 82 further includes an air mattress pump 330 contained entirely within the air mattress side rail body 300. The air mattress side rail 82 may further include an air mattress pump controller 336 coupled to the air mattress pump 330 and a user interface 338 with user inputs 340, and a display 341 for controlling the functions of the air mattress pump 330. The user interface 338 is coupled to the air mattress pump controller 336 and may be located on the interior (patient-facing) or exterior (caregiver-facing), or both, of the air mattress side rail body 300 (see FIGS. 5A-5B).

The air mattress pump controller 336 may be in communication with and may control any suitable components of the air mattress side rail 82. The air mattress pump controller 336 may comprise any suitable signal processing means, computer executable instructions or software modules stored in a memory M (see FIG. 4E), including a non-volatile memory or volatile memory, wherein the executable instructions or modules may be executed by a processor, or the like. Additionally, or alternatively, the air mattress pump controller 336 may comprise a microcontroller, a processor, one or more integrated circuits, logic parts, and the like for enabling the same. The air mattress pump controller 336 may have any suitable configuration for enabling performance of various tasks related to operation of the air mattress side rail 82. The air mattress pump controller 336 may be located at any suitable location of the air mattress side rail 82.

Figure 4B:
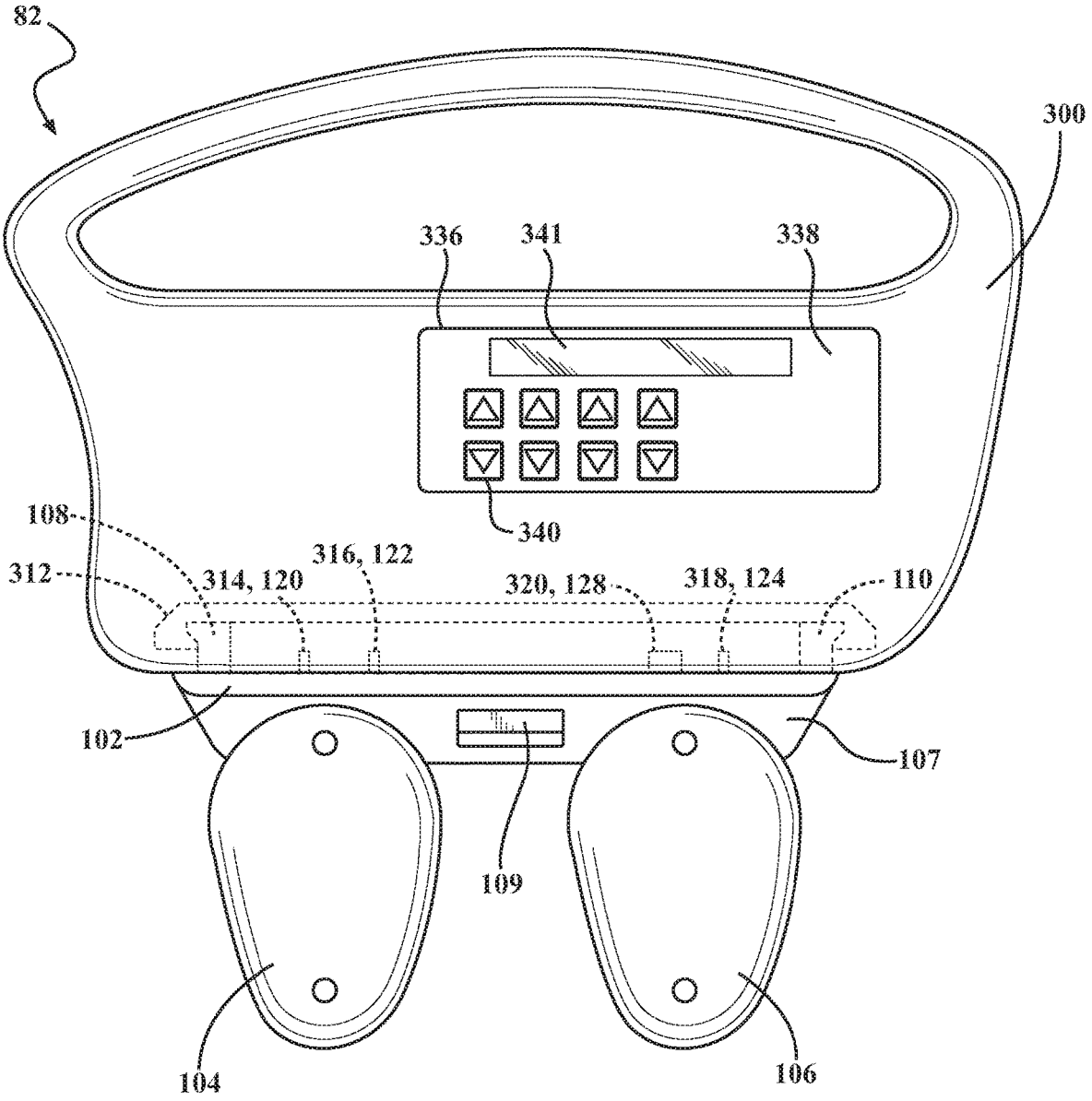
FIG. 4B is a front view of the air mattress side rail assembly of FIG. 4A.

Referring now to FIG. 4B, a front view of the air mattress side rail assembly in its assembled form is shown. The side rail body 300 is shown coupled to the side rail connector 102. The latches 108, 110 are engaged with the retaining bar 312 to hold the side rail body 300 in place. The data connectors, such as the data posts 120, 122, and 124 are engaged in data connectors, such as the ports 314, 316, and 318, respectively. The power supply connector 128 is engaged with the power port 320.

Figure 4C:
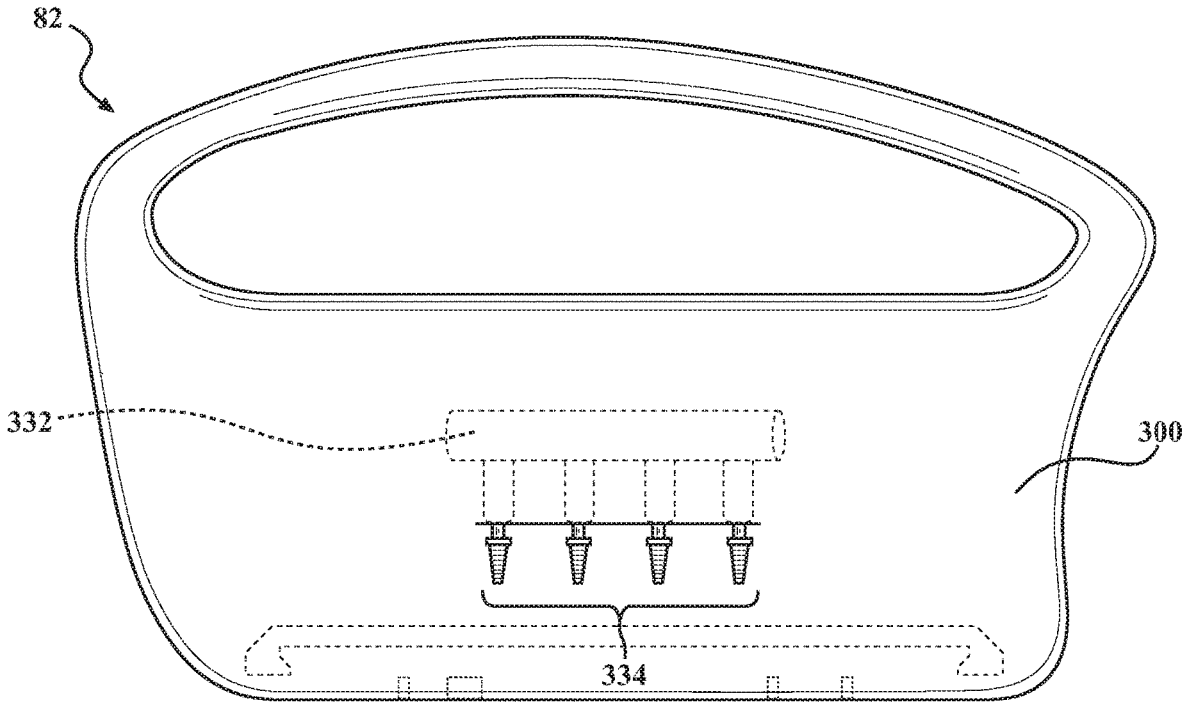
FIG. 4C is a rear view of the air mattress side rail assembly of FIG. 4A.

Referring now to FIG. 4C, a rear view of the air mattress side rail assembly is shown. The air mattress side rail body 300 further includes an air mattress manifold 332, which connects the air mattress pump 330 to mattress ports 334 (although four mattress ports 334 are shown, it will be understood that more or fewer ports may be included). The air mattress ports 334 (also referred to as fluid ports) may be connected to tubing on the mattress 50 (see FIG. 1), which may be an air mattress. The air mattress pump 330 pumps air in and out of the mattress 50 via the mattress ports 334, which may be desirable to alter the configuration or firmness of the mattress for patient comfort, ulcer prevention, and the like. The user interface 338 may be used to control the functions of the air mattress pump 330 and control fluid flow through the mattress ports 334 and to the mattress 50 (the mattress ports 334 may be controlled, e.g., open/closed, using a combination of one or more sensors and one or more electronic control valves in the manifold 332, see FIG. 4E.

Figure 4D:
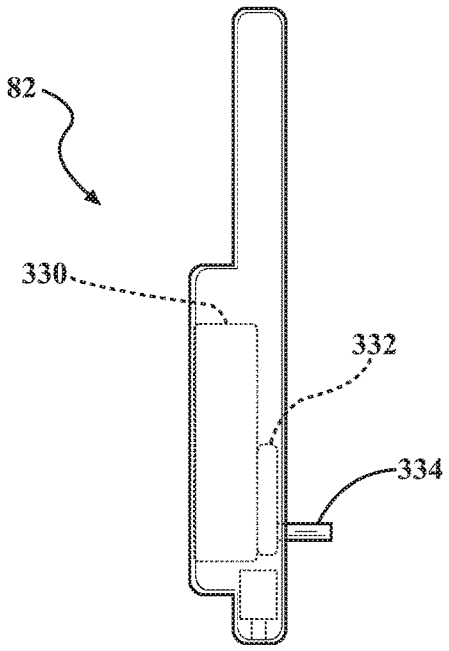
FIG. 4D is side view of the air mattress side rail assembly of FIG. 4A.

FIG. 4D shows a side view of the air mattress side rail assembly with a protruding side portion defining a cavity sized to contain the air mattress pump 330 and manifold 332. A similarly sized and shaped cavity could be used for the DVT pump 230.

Figure 4E:
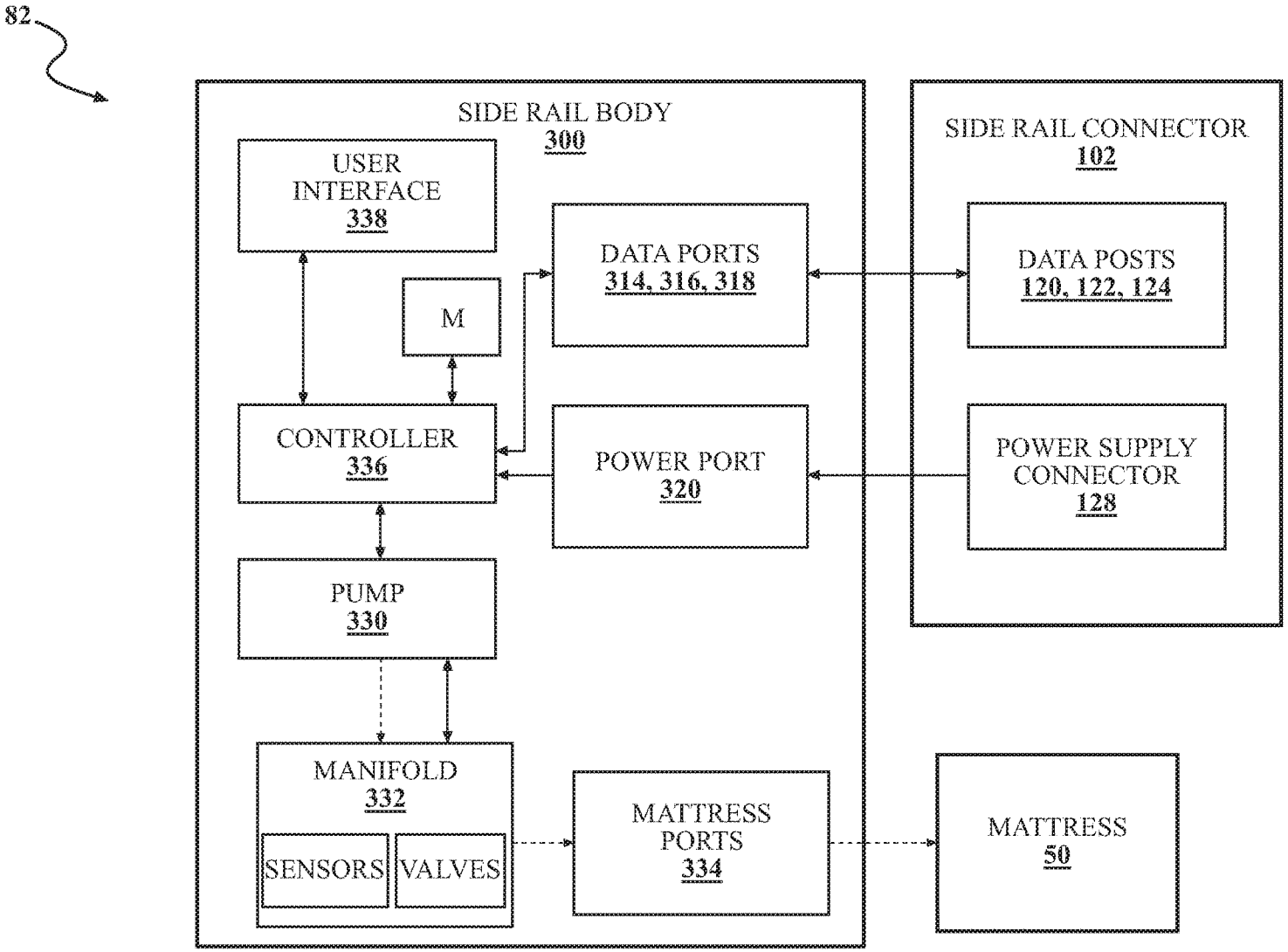
FIG. 4E is a diagram illustrating the air mattress side rail assembly of FIGS. 4A-4D.

Referring now to FIG. 4E, a diagram illustrating the air mattress side rail assembly is shown. Electrical connections, data connections, and air flow connections are illustrated in FIG. 4E.

Figure 5A:
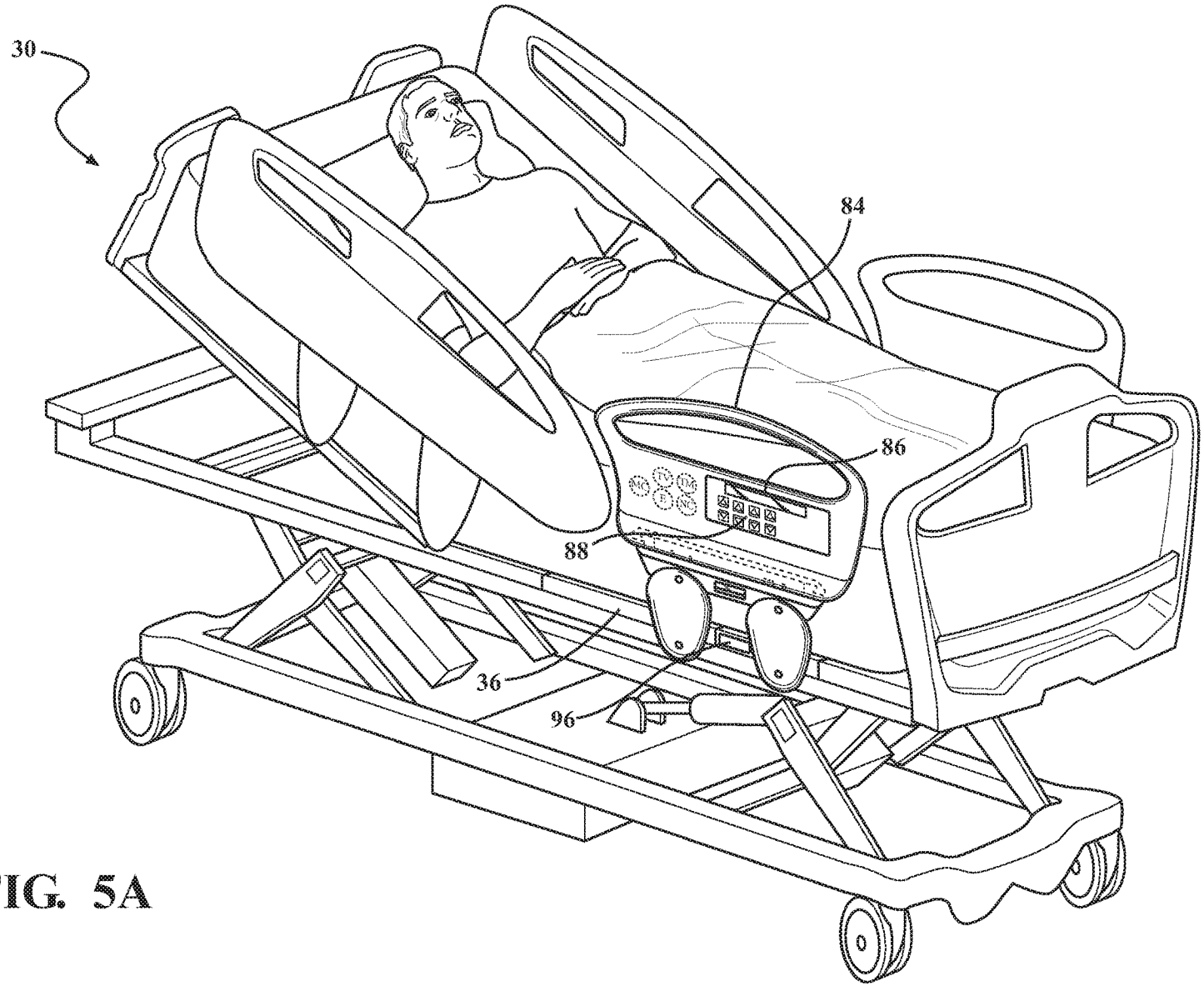
FIG. 5A is a perspective view of a patient support apparatus having an interchangeable side rail with outward-facing user inputs.

Referring now to FIG. 5A, a perspective view of a patient support apparatus having an interchangeable side rail with outward-facing user inputs is shown. A side rail 84 (which may be, for example, the standard side rail 54, 58, the DVT side rail 80, the air mattress side rail 82, or other interchangeable side rail) is shown coupled to the support frame 36. The side rail 84 comprises a user interface 86 with user inputs 88. The user inputs 88 may control the functions of the side rail 84 and/or its accessories. In some embodiments, the user inputs 88 may be the same as user inputs 238 and/or 340, and the user interface 86 may be the same as the user interface 236 and/or 338, respectively. In some embodiments, one or more user inputs 88 may control communication (e.g., emergency/code alerts (E), a nurse call controller (NC) communicatively coupled to a nurse station for a nurse call function, etc.). Alternatively or in addition, one or more user inputs 88 may control patient comfort or entertainment functions (e.g., television controller (TV), music controller (MC), temperature management (TM) controller, etc.). Alternatively or in addition to controlling the functions of the side rail 84 and/or its accessories, one or more user inputs 88 may control certain positioning or movement functions of the patient support apparatus 30, such as articulation or lift. In the illustrated embodiment, the user interface 86 and the user inputs 88 are outward-facing for easy access by a caregiver.

Figure 5B:
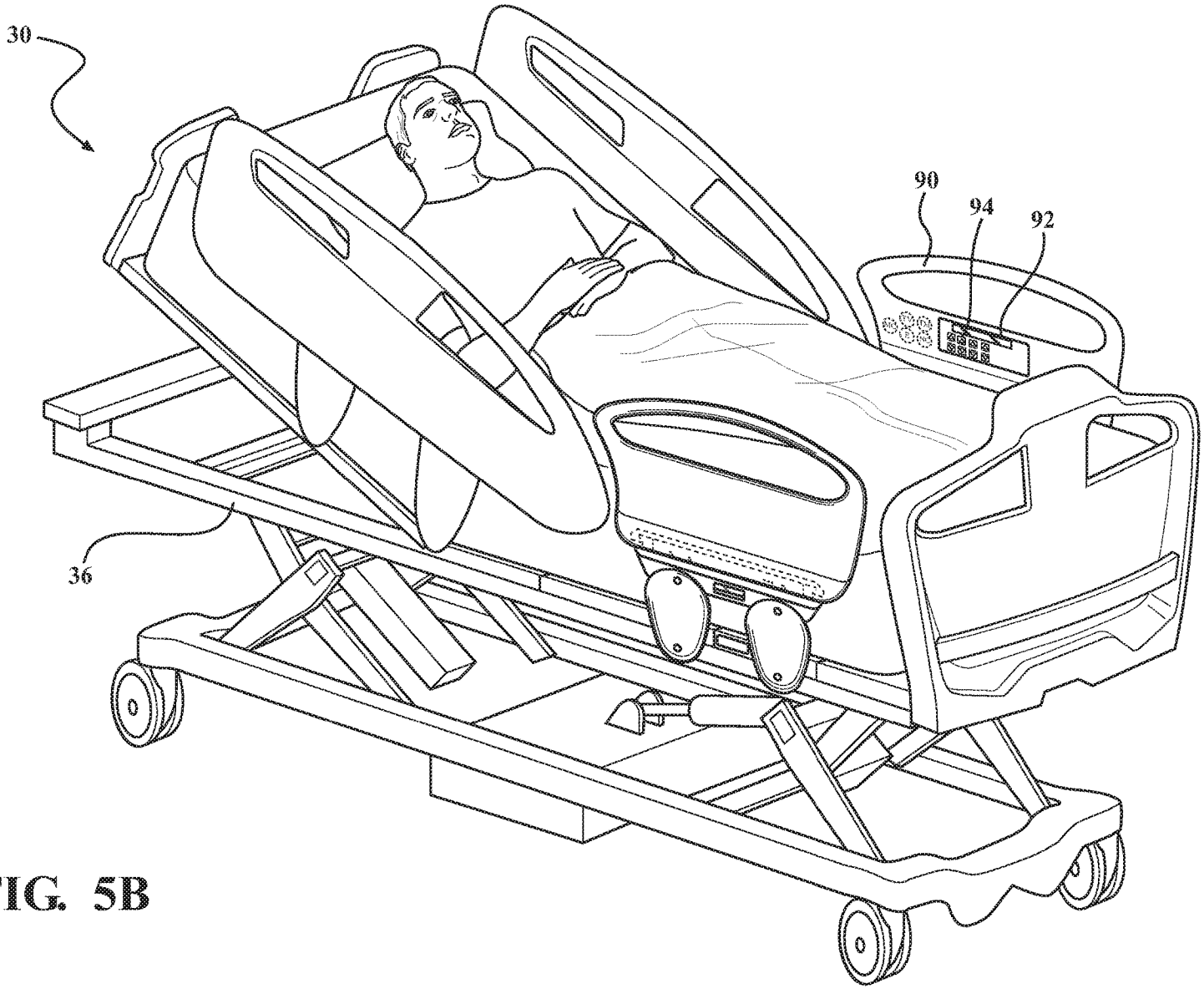
FIG. 5B is a perspective view of a patient support apparatus having an interchangeable side rail with inward-facing user inputs.

Referring now to FIG. 5B, a perspective view of a patient support apparatus having an interchangeable side rail with inward-facing user inputs is shown. A side rail 90 (which may be, for example, the standard side rail 54, 58, the DVT side rail 80, the air mattress side rail 82, or other interchangeable side rail) is shown coupled to the support frame 36. The side rail 90 comprises a user interface 92 with user inputs 94. The user inputs 94 may control the functions of the side rail 90 and/or its accessories. In some embodiments, the user inputs 94 may be the same as the user inputs 238 and/or 340, and the user interface 92 may be the same as the user interface 236 and/or 338, respectively. In some embodiments, the user inputs 94 may control communication (e.g., emergency/code alerts (E), a nurse call controller (NC) communicatively coupled to a nurse station, etc.). Alternatively or in addition, user inputs 94 may control patient comfort or entertainment functions (e.g., television controller (TV), music controller (MC), temperature management (TM) controller, etc.). Alternatively or in addition to controlling the functions of the side rail 90 and/or its accessories, one or more user inputs 94 may control certain positioning or movement functions of the patient support apparatus 30, such as articulation or lift. In the illustrated embodiment, the user interface 92 and the user inputs 94 are inward-facing for easy access by a patient. In other embodiments, the user interface 92 and the user inputs 94 may be inward-facing and/or outward-facing.

Although each of the side rails disclosed herein are illustrated as lower (foot end) side rails, it will be understood that any of the side rails could instead be utilized as upper (head end) side rails for the patient support apparatus 30. In addition, it will be appreciated that any of the side rails disclosed herein may be fully interchangeable between any of the various side rail positions, including lower (foot end), upper (head end), left side, and right side of the patient support apparatus 30.

Advantages of these various embodiments include, for example, easy exchange of side rails that have a variety of fully integrated accessories, according to a patient's current needs. This eliminates the need for accessories and their cords/cables to be hung from or draped over other parts of the patient support apparatus 30 (e.g., the footboard 62 or the headboard assembly 60), which keeps the footprint of the patient support apparatus 30 from unnecessarily increasing and improves access by caregivers to the patient. It also eliminates tangling and tripping hazards that may be caused by loose cords/cables.

Additionally, it will be appreciated that any combination of the features/functions in any one of the side rail embodiments shown and described herein may be incorporated into a single side rail. For instance, any combination of the user inputs 88, 238 and/or 340 may be used on a single interchangeable side rail. Similarly, any one or combination of the user interfaces 86, 236, and/or 338 may be used on a single interchangeable side rail. Moreover, side rails with different features/functions to those shown are also contemplated. For instance, a thermal therapy side rail may be possible, similar to the DVT side rail 80, except that the thermal therapy side rail has a thermal therapy pump for liquid (the pump coupled to the controller), temperature sensors for determining liquid temperature, a water reservoir and fluid circuit coupled to the thermal therapy pump, and liquid ports for connection to thermal therapy pads, blankets, garments, and the like. It will also be appreciated that any combination of side rails with any combination of features/functions may be used on a single patient support apparatus. For example, the patient support apparatus 30 may have two standard side rails 52, 56 (upper/head end), a DVT side rail 80 (lower/foot end), and an air mattress side rail 82 (lower/foot end). In another embodiment, the patient support apparatus 30 may have one DVT side rail 80 (upper/head end), and three standard side rails 52, 54, 56 (one upper/head end, two lower/foot end). It will be understood that side rail combinations may be reconfigurable based on current patient needs. In some embodiments, the patient support apparatus 30 may contain software for each type of side rail.

A sensor (shown in FIG. 5A as 96) on the support frame 36 or other suitable location may detect which side rail(s) is/are connected so that the controller 67 is able to enable features in the side rails based on the type of side rail detected. One exemplary sensor configured to detect the coupling/decoupling of accessory devices (e.g., a DVT accessory) that could be employed here to detect the coupling/decoupling of the various side rails(s) is described in U.S. Pat. No. 9,642,759 to Stryker et al., filed on Nov. 20, 2014, entitled "Patient Support Apparatus with Universal Energy Supply System," hereby incorporated by reference herein in its entirety.

In some embodiments, the sensor 96 may be located at each side rail interface, i.e., where the side rail body 100, 200, 300 engages the side rail connector 102 and may be coupled to the controller 67 to identify the type of side rail body 100, 200, 300 being connected and to obtain any other information regarding its available accessories/functions/features. The side rail bodies 100, 200, 300 may comprise RFID tags, bar codes, or other unique identifiers to identify the type of side rail to the controller 67. For example, the sensor 96 may comprise an RFID reader that detects the RFID tag associated with the side rail body 100, 200, or 300, with the RFID tag identifying the type of side rail and providing information about any available accessories/functions/features. For instance, the sensor 96 may be mounted to the side rail connector 102 on an upper surface thereof and the RFID tag or other unique identifier may be mounted to a lower surface of the side rail body 100, 200, 300 such that when the side rail bodies 100, 200, 300 are coupled to the side rail connector 102, the sensor 96 and RFID tag are aligned and disposed adjacent to one another so that the sensor 96 can detect the RFID tag to read the necessary information. Additionally, the sensor 96 may be located on the side rail bodies 100, 200, 300, with the RFID tag or other unique identifier being located on the interface. Identification of the type of side rail and/or other information may also be accomplished by virtue of communication between wired and/or wireless communication devices on the side rail body 100, 200, 300, and on the support frame 36 or other suitable location, such as communication between transmitters, receivers, transceivers, etc., which may communicate via radio frequency, infrared, and the like.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus comprising:

a support structure comprising a base and a patient support surface for supporting a patient;

a side rail connector coupled to the support structure and comprising a power connector;

a first side rail removably coupled to the support structure by the side rail connector, the first side rail comprising:

a first side rail body having a first coupling for releasably coupling to the side rail connector; and a first accessory configured to receive power via electrical communication across the power connector established by releasably coupling the first coupling to the side rail connector; and a second side rail comprising:

a second side rail body having a second coupling for releasably coupling to the side rail connector, and a second accessory, of a type different from the first accessory and configured to perform a different function than the first accessory, the second accessory configured to receive power via electrical communication across the power connector established by releasably coupling the second coupling to the side rail connector;

wherein the first side rail is configured to be removable from the support structure and interchanged with the second side rail, wherein the second side rail is configured to be removably coupled to the support structure by the side rail connector.

2. The patient support apparatus of claim 1, wherein the side rail connector comprises a data connector configured to supply a data connection to the first side rail and the second side rail.

3. The patient support apparatus of claim 1, wherein the first accessory comprises a first pump and the second accessory comprises a second pump, different than the first pump.

4. The patient support apparatus of claim 3, wherein:

the first accessory comprises a first pump controller coupled to the first pump, one or more first fluid ports, and a first user interface coupled to the first pump controller; and the second accessory comprises a second pump controller coupled to the second pump, one or more second fluid ports, and a second user interface coupled to the second pump controller.

5. The patient support apparatus of claim 4, wherein the one or more first fluid ports are configured to connect to a deep vein thrombosis garment and the first user interface is configured to control the first pump controller to inflate and deflate the deep vein thrombosis garment.

6. The patient support apparatus of claim 4, wherein the one or more first fluid ports are configured to connect to an air mattress and the first user interface is configured to control the first pump controller to inflate and deflate the air mattress.

7. The patient support apparatus of claim 1, wherein the first side rail comprises one or more user inputs for controlling one or more of an entertainment function, movement function, or nurse call function.

8. The patient support apparatus of claim 1, wherein the first side rail is adjustable into one or more positions relative to the support structure.

9. The patient support apparatus of claim 1, wherein the second side rail is adjustable into one or more positions relative to the support structure.

10. A patient support apparatus comprising:

a support structure comprising a base and a patient support surface for supporting a patient;

a first side rail connector coupled to the support structure and comprising a power connector;

a first side rail removably coupled to the support structure by the first side rail connector, the first side rail comprising:

a first side rail body having a first coupling for releasably coupling to the first side rail connector, and a first accessory configured to receive power via electrical communication across the power connector established by releasably coupling the first coupling to the first side rail connector;

a second side rail configured to be removably coupled to the support structure by the first side rail connector, the second side rail comprising:

a second side rail body having a second coupling for coupling to the first side rail connector, and a second accessory, of a type different from the first accessory and configured to perform a different function than the first accessory, the second accessory configured to receive power via electrical communication across the power connector established by releasably coupling the second coupling to the first side rail connector;

wherein the first side rail is configured to be removable from the support structure and interchanged with the second side rail;

a second side rail connector coupled to the support structure; and a third side rail removably coupled to the support structure by the second side rail connector, wherein the third side rail is configured to be removable from the support structure and interchanged with a fourth side rail, wherein the fourth side rail is configured to be removably coupled to the support structure by the second side rail connector.

11. The patient support apparatus of claim 10, wherein the first side rail connector comprises a data connector configured to supply a data connection to the first side rail and the second side rail.

12. The patient support apparatus of claim 10, wherein the second side rail connector comprises a power connector configured to supply power to the third side rail and the fourth side rail.

13. The patient support apparatus of claim 10, wherein the second side rail connector comprises a data connector configured to supply a data connection to the third side rail and the fourth side rail.

14. The patient support apparatus of claim 10, wherein:

the third side rail comprises a third accessory, and the fourth side rail comprises a fourth accessory that is different than the third accessory.

* * * * *